US006795034B2

(12) United States Patent
Lyerly et al.

(10) Patent No.: US 6,795,034 B2
(45) Date of Patent: Sep. 21, 2004

(54) GREGORIAN ANTENNA SYSTEM FOR SHAPED BEAM AND MULTIPLE FREQUENCY USE

(75) Inventors: Albert E. Lyerly, Fullerton, CA (US); Parthasarathy Ramanujam, Torrance, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/192,364

(22) Filed: Jul. 10, 2002

(65) Prior Publication Data

US 2004/0008148 A1 Jan. 15, 2004

(51) Int. Cl.[7] ..... H01Q 13/00
(52) U.S. Cl. ..... 343/781 CA; 343/781 P
(58) Field of Search ..... 343/781 P, 781 CA, 343/753, 840, 909, 773, 836, 837, 838

(56) References Cited

U.S. PATENT DOCUMENTS 5,576,721 A * 11/1996 Hwang et al. ..... 343/781 P
6,545,645 B1 * 4/2003 Wu ..... 343/781 P

* cited by examiner

*Primary Examiner*—Hoang V. Nguyen

(57) ABSTRACT

A method and system for shaped beam and multiple frequency use having a shaped main reflector, two feeds having separate and distinct frequency bands, a first shaped sub-reflector having a frequency selective surface and a second shaped sub-reflector. The first shaped sub-reflector has the electrical property of reflecting one frequency band and passing another. A second desired frequency band from the second feed passes through the tuned FSS surface of the first sub-reflector and reflects off the second sub-reflector towards the main reflector.

16 Claims, 2 Drawing Sheets

GREGORIAN ANTENNA SYSTEM FOR SHAPED BEAM AND MULTIPLE FREQUENCY USE

TECHNICAL FIELD

The present invention relates generally to a Gregorian reflector antenna system and more particularly to a Gregorian reflector antenna system having a shaped main reflector, a shaped sub-reflector with a frequency selective surface, and at least another shaped sub-reflector.

BACKGROUND OF THE INVENTION

In a communication satellite antenna it is desirable to direct antenna energy to a region on the earth, such as a specific business market or political region. In order to maximize the utilization of the satellite, the signal carrying capacity managed by the satellite must be maximized. This is usually accomplished using multiple frequency bands. It is preferred to use a single antenna for multiple band operation to minimize weight and volume to the spacecraft antenna. However, a negative aspect to this technique is the limited frequency response (bandwidth) of the feeds.

Typically, the single antenna can accommodate frequency band separation of up to two to one. However, at larger bandwidths it becomes extremely difficult, if not impossible, to design a working feed. One solution to this problem is to divide the frequency band into smaller sub-bands and assign a feed to each particular sub-band, thereby maintaining the maximum signal carrying capacity of the satellite. This obviously requires many antennas and so is not efficient from a mass and volume point of view.

In addition to the large bandwidth and multiple frequency bands, it is desirable for the antenna to produce a shaped beam at the multiple frequencies. A typical satellite reflector antenna is required to produce a shaped beam that is configured to the shape of a particular market region. In the prior art this is accomplished by using multiple feeds placed at the reflector focus region in order to produce the desired shape in the antenna far field pattern. The feeds can be direct radiating to the earth, or the feeds can illuminate a reflector. A combiner network is used to distribute energy to each of the many feeds required to produce the shaped beam. The consequential result is an increase in weight and volume to the satellite antenna system.

Another drawback to multiple feeds is the potential for electrical coupling between feeds. This mutual coupling between feeds will lead to undesirable effects, which cannot be eliminated even with known analysis techniques.

In the prior art, it is known to replace the multiple feeds with a single feed and shape the main reflector, the sub-reflector or both. Therefore, the additional feeds and the combiner network are no longer required, and the weight and space constraints to the satellite are improved. The current invention extends this approach to a dual reflector system with a Frequency Selective Surface shaped sub-reflector antenna. There are two approaches in the prior art with reference to a dual reflector with a FSS sub-reflector.

The known approach uses a dual reflector antenna such as a Cassegrain geometry, with a FSS sub-reflector. The FSS sub-reflector has the electrical property of passing one frequency band and reflecting another frequency band to the shaped sub-reflector. In this respect, the FSS can be designed to operate in a multiple octave frequency range. An antenna system requiring large bandwidths is capable of assigning a feed to a portion of the band, and with the cooperation of the FSS sub-reflector, is capable of accommodating multiple bands.

The second approach uses Gregorian dual reflector configuration with an ellipsoidal FSS sub-reflector. Since the feeds for this approach are on the same side of the sub-reflector multiple FSS surfaces are used within the sub-reflector, each surface reflecting one frequency band and transmitting all others. The prior art discusses this geometry where the sub-reflectors are ellipsoids and the main reflector is a paraboloid. In this approach shaped beams can only be generated using a feed array and a beam forming network. The current invention improves this approach by replacing a feed array with a single feed by shaping the reflector to produce the shaped beams and enhancing the performance by shaping the sub-reflector. Since the two feeds are on the same side of the sub-reflector, an additional advantage of the present invention is the reduced coupling between the two feeds for the two frequency bands since the feed radiation is usually very low in the direction perpendicular to the direction of peak radiation i.e., the direction of the other feed.

With the dual-reflector/multiple-beam antennas, it is desirable to direct antenna energy across the full frequency band of operation to specific regions. The main reflector beam is shaped and optimized for the best possible electrical performance over the full band of frequencies. However, it is desirable to optimize for maximum antenna gain across the frequency band. This is not possible with the prior art systems. This is provided by the capability to shape the sub-reflector(s).

There is a need for high feed-to-feed isolation in multiple frequency antenna applications that do not add unwanted size and weight to the antenna system. It is desirable for a single spacecraft antenna to produce a shaped beam at widely spaced frequency bands and still be compact and lightweight. It is also desirable to optimize for maximum antenna gain across the frequency band.

SUMMARY OF THE INVENTION

The present invention is a Gregorian antenna system having a shaped main reflector and two shaped sub-reflector surfaces. One or more feeds tuned to each frequency band feed the antenna of the present invention. The first shaped sub-reflector surface is a FSS and the second may be either a solid conducting surface or FSS. According to the present invention, each sub-reflector has its own unique focus location at which a feed is positioned. The two shaped sub-reflector geometries are adjusted such that each focus location can be optimally placed. For example, side by side and almost parallel to each other. This reduces the coupling eliminating the need for any filters for band filtering.

The shaped main reflector surface is capable of producing shaped beam contours in the antenna far field. The shaped main reflector is optimized across the entire band of frequencies. For multiple band operation, the sub-reflectors can also be shaped in coordination with the shaped main reflector to optimize the far field contour. The FSS surface of at least one of the sub-reflectors ensures the proper band of frequencies reaches a particular shaped sub-reflector.

Typical horn feeds have low illumination characteristics at ninety degrees from the aperture plane. Therefore, placing multiple feeds side-by-side takes advantage of this low illumination characteristic. This natural isolation is advantageous to the Gregorian reflector geometry and the adjustable focus location of the FSS sub-reflector according to the present invention.

According to the present invention, a first focus location from the first shaped sub-reflector, a second focus location from the second shaped sub-reflector and Gregorian shaped main reflector geometry are combined with multiple feeds adjacent to each other allowing for naturally high feed-to-feed isolation, thereby eliminating the need for band filtering for each feed. In addition, simultaneous multiple band use is possible when the antenna is used with multiple feeds. The compact Gregorian reflector geometry provides lower antenna volume and lower weight to offset multiple reflector antennas. Further, the present invention allows for low feed losses. The feeds are located close to the base of the antenna, and therefore connections are kept short.

It is an object of the present invention to provide optimized shaped far field patterns using a shaped main reflector and a single band-tuned shaped sub-reflector. It is another object of the present invention to have a FSS shaped sub-reflector to select the particular frequency band for the FSS shaped sub-reflector.

Yet another object of the present invention is to provide a multiple band antenna system having single feeds for each band of operation. Still another object of the present invention to have high feed-to-feed isolation.

It is a further object of the present invention is to reduce the weight and size of the antenna system and maintain high feed-to-feed isolation. It is yet a further object of the present invention is to provide a compact antenna size. Still a further object of the present invention is to located the feeds at the base of the antenna to keep transmission lines short and losses low.

Other objects and advantages of the present invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF PREFERRED EMBODIMENTS

Figure 1:
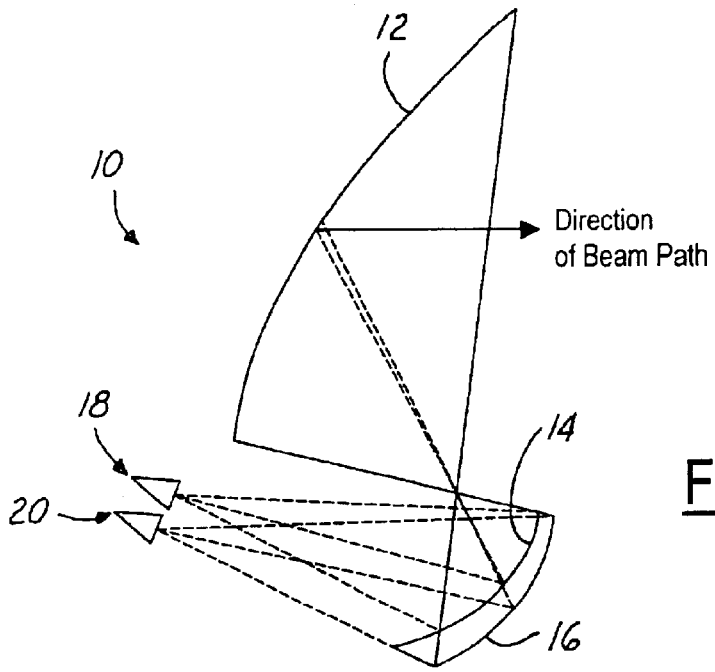
FIG. 1 is a diagram of a Gregorian multiple sub-reflector system of the present invention.

FIG. 1 is a side view of a Gregorian multiple sub-reflector antenna system 10 according to the present invention. A main reflector 12 is shown and has a shaped surface to produce an optimized far field shaped beam for the feeds. One skilled in the art is capable of substituting other reflector geometries without departing from the scope of the present invention. A first sub-reflector 14 has a frequency selective surface (FSS), and is a shaped surface sub-reflector. A second sub-reflector 16 may be a solid conducting shaped surface. It should be noted that the second sub-reflector may also be a frequency selective surface, and one skilled in the art is capable of substituting the sub-reflector without departing from the scope of the present invention.

The first shaped sub-reflector 14 is illuminated by a first feed 18 producing a first frequency band signal. The first frequency band signal is reflected off the surface of the first shaped reflector 14 and on to the shaped main reflector 12. The first frequency band signal is then reflected off the main reflector 12 to produce a shaped pattern in the far field of the main reflector.

A second feed 20 illuminates the second shaped sub-reflector 16. The first shaped sub-reflector 14 is tuned to pass the second frequency band. The second frequency band from the second feed 20 reflects off the second shaped sub-reflector 16. The signal then bounces off the main reflector 12 to produce a shaped pattern in the far field of the main reflector.

The shaped main reflector is common to both beams. Each of the two shaped sub-reflectors offers one degree of additional freedom to optimize the coverage area for each beam.

Figure 2:
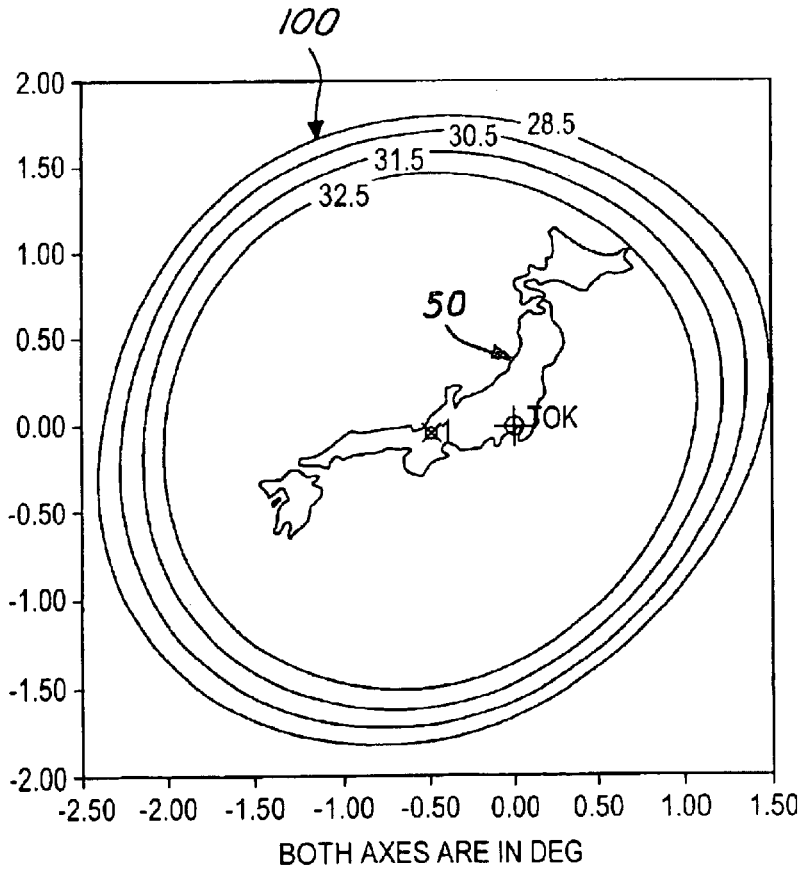
FIG. 2 is a far field radiation pattern for mainland Japan at S band frequencies.
Figure 3:
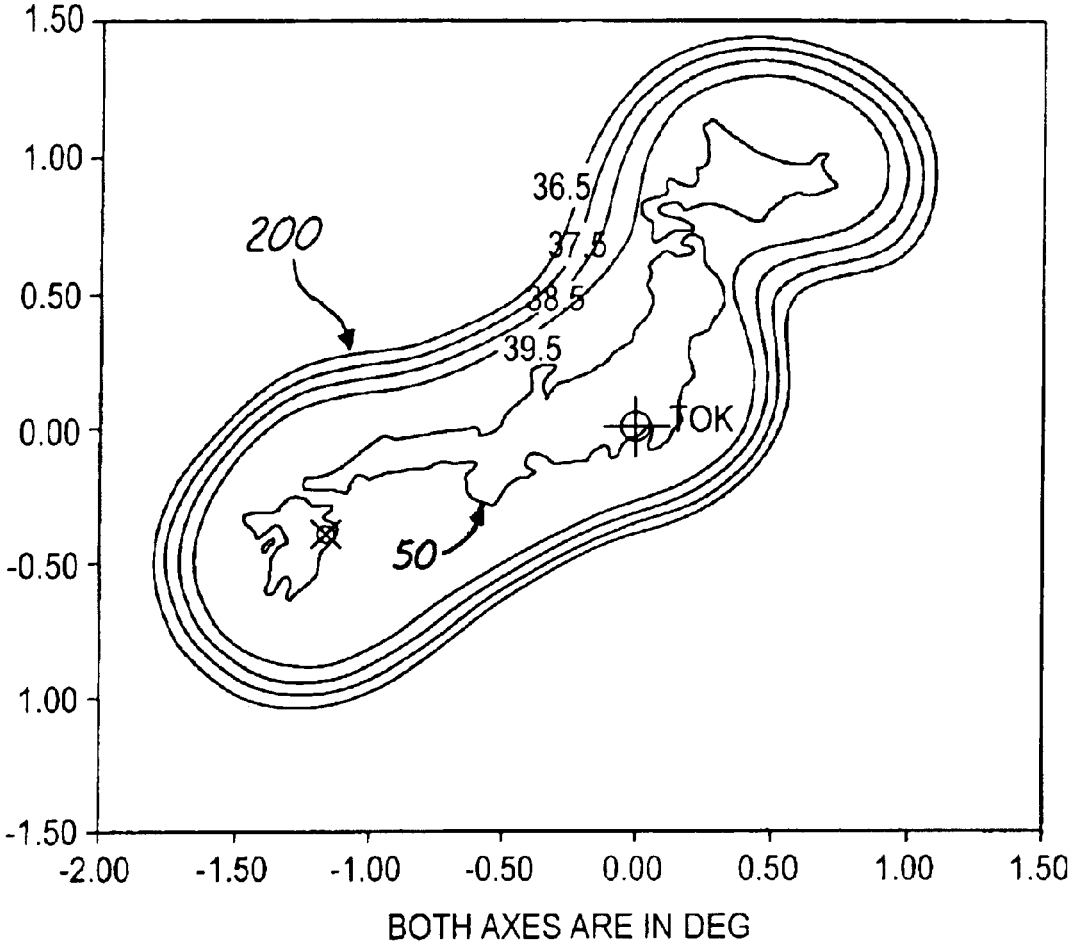
FIG. 3 is a far field radiation pattern for mainland Japan at Ku band frequencies.

FIGS. 2 and 3 show examples of the optimized shaped beam for mainland Japan 50. FIG. 2 illustrates a shaped beam 100 optimized for mainland Japan for S-band frequency of 4 GHz. FIG. 3 illustrates a shaped beam 200 optimized for mainland Japan for Ku-band frequency of 12 GHz. In both Figures, the contours are in 1 dB steps.

Referring again to FIG. 1 in accordance with the example in FIGS. 2 and 3, the main reflector beam would be shaped to produce the outline of the country. The first sub-reflector 14 and the shaped main reflector would be optimized for Ku band response and the second sub-reflector 16 and the main reflector would be optimized for S-band response.

According to the present invention, the FSS first shaped sub-reflector 14 has the electrical property of reflecting one frequency band and passing another. Therefore, the FSS first sub-reflector 14 is used to select and direct various bands of frequencies to the main reflector. For example, the first frequency band emerges from the first feed 18 and is reflected by the tuned FSS surface of the first sub-reflector 14 toward the main reflector 12, so as to result in a desired beam shape in the far field. The second desired frequency band from the second feed 20 passes through the tuned FSS surface of the first sub-reflector 14 and reflects off the second sub-reflector 16 towards the main reflector 12. The desired far field beams of the first and second frequency bands are collinear and operate independently from each other.

The first and second feeds, 18 and 20 respectively, are placed adjacent and parallel to one another. Therefore, the low illumination characteristics at ninety degrees that are inherent to the feeds, provide natural isolation. The compact Gregorian reflector geometry and the adjustable focus location of the first shaped FSS sub-reflector use the natural isolation to their advantage.

The natural isolation reduces, or eliminates, the need for band filtering for each feed. According to the present invention, one antenna is capable of performing the work of many. When the antenna of the present invention is used with multiple feeds, there is simultaneous, multiple band capabilities.

In one embodiment of the present invention, the feeds are located close to the base of the antenna. Therefore, connections to base supported antenna electronics are kept short. This feature further minimizes low feed losses, and keeps the antenna compact and lightweight.

The present invention is advantageous in that it provides shaped reflector surfaces, thereby optimizing the coverage for a particular band of frequencies. Each sub-reflector is independently shaped. There are differences in the shape of the first sub-reflector and the second sub-reflector in order to optimize coverage for their respective band of frequencies.

The invention covers all alternatives, modifications, and equivalents, as may be included within the spirit and scope of the appended claims. For example, the present invention is not limited to a single feed per sub reflector. It is possible to apply multiple feeds to the present invention without departing from the scope of the present invention.

What is claimed is:

1. A Gregorian antenna system comprising:

a shaped main reflector;

a first shaped sub-reflector having a frequency selective surface;

a first feed illuminating said first shaped sub-reflector and generating a first signal in a first frequency band;

a second shaped sub-reflector;

a second feed illuminating said second shaped sub-reflector and generating a second signal in a second frequency band;

said first shaped sub-reflector being tuned to pass said signal in said second frequency band;

said first signal reflecting off said first shaped sub-reflector to said shaped main reflector where said first signal is reflected off said main reflector producing a shaped beam in a far field of said main reflector;

said second signal passing through said first shaped sub-reflector, reflecting off said second shaped sub-reflector to said shaped main reflector where said second signal is reflected off said main reflector producing another shaped beam in a far field of said main reflector.

2. The antenna system as claimed in claim 1 wherein said second shaped sub-reflector further comprises a frequency selective surface.

3. The antenna system as claimed in claim 1 wherein said first frequency band is S-band and said second frequency band is Ku band.

4. The antenna system as claimed in claim 1 wherein said second shaped sub-reflector further comprises a solid surface.

5. The antenna system as claimed in claim 1 wherein said first and second feeds are located at a base of said shaped main reflector.

6. The antenna system as claimed in claim 1 wherein said first and second feeds further comprise high power transmit feeds.

7. The antenna system as claimed in claim 1 wherein said first and second feeds further comprise an array of feeds.

8. A simultaneous multiple band antenna system comprising:

a first feed for a first frequency band;

a second feed for a second frequency band;

a shaped main reflector;

a first shaped sub-reflector illuminated by said first feed and reflecting signals in said first frequency band to said shaped main reflector, said first shaped sub-reflector having a frequency selective surface tuned to pass signals in said second frequency band;

a second shaped sub-reflector illuminated by said second feed and reflecting signals in said second frequency band to said shaped main reflector;

said shaped main reflector reflecting signals in said first and second frequency bands to produce two independent shaped beams in a far field of said shaped main reflector.

9. The antenna system as claimed in claim 8 wherein said first and second frequency bands are widely separated in frequency.

10. The antenna system as claimed in claim 8 wherein said first and second feeds are located close to a base of said shaped main reflector.

11. The antenna system as claimed in claim 8 wherein said first and second feeds are high power transmit feeds.

12. A method for producing a shaped beam in an antenna system having a shaped main reflector and first and second shaped sub-reflectors wherein said first shaped sub-reflector has a frequency selective surface, said method using at least two feeds having separate and distinct frequency bands, said method comprising the steps of:

illuminating the first shaped sub-reflector with a first feed having a first frequency band;

tuning the first shaped sub-reflector to pass signals having a frequency outside of the first frequency band;

reflecting signals in the first frequency band from the first shaped sub-reflector to the shaped main reflector;

illuminating the second shaped sub-reflector with a second feed having a second frequency band that is separate and distinct from the first frequency band; reflecting the signals in the second frequency band from the second shaped sub-reflector to the shaped main reflector; and reflecting the signals reflected from the first and second shaped sub-reflectors to a far field of the shaped main reflector.

13. The method as claimed in claim 12 wherein said first and second frequency bands are separated by greater than 1.6 ratio of frequency separation.

14. The method as claimed in claim 12 further comprising the step of tuning said first shaped sub-reflector having a frequency selective surface to pass signals having frequencies outside of said first frequency band.

15. The method as claimed in claim 12 further comprising the step of locating said first and second feeds near a base of the shaped main reflector.

16. The method as claimed in claim 12 wherein said second shaped sub-reflector has a frequency selective surface and further comprising the step of: tuning said second shaped sub-reflector to pass signals having a frequency outside of said second frequency band.

* * * * *